US006200637B1

(12) United States Patent
McClain et al.

(10) Patent No.: US 6,200,637 B1
(45) Date of Patent: Mar. 13, 2001

(54) METHOD OF COATING A SUBSTRATE IN CARBON DIOXIDE WITH A CARBON-DIOXIDE INSOLUBLE MATERIAL

(75) Inventors: James B. McClain, Carrboro; Timothy J. Romack; James P. DeYoung, both of Durham, all of NC (US)

(73) Assignee: MiCell Technologies, Inc., Raleigh, NC (US)

( * ) Notice: Subject to any disclaimer, the term of this patent is extended or adjusted under 35 U.S.C. 154(b) by 0 days.

(21) Appl. No.: 09/566,408

(22) Filed: May 8, 2000

Related U.S. Application Data

(63) Continuation of application No. 09/527,193, filed on Mar. 17, 2000, which is a continuation of application No. 09/479,566, filed on Jan. 7, 2000, which is a continuation of application No. 09/090,330, filed on May 29, 1998, now Pat. No. 6,030,663, which is a continuation-in-part of application No. 08/866,348, filed on May 30, 1997, now abandoned.

(51) Int. Cl.[7] ..... B05D 3/10

(52) U.S. Cl. ..... 427/336; 427/388.1; 427/389.7; 427/389.9; 427/393.4; 427/393.5; 427/393.6; 427/394; 427/435; 427/439

(58) Field of Search ..... 427/389.9, 393.4, 427/439, 389.7, 388.1, 393.5, 393.6, 336, 394, 435

(56) References Cited

U.S. PATENT DOCUMENTS

| | | | |
|---|---|---|---|
| 2,841,573 | 7/1958 | Ahlbrecht et al. | 260/79.3 |
| 3,282,905 | 11/1966 | Fasick et al. | 260/89.5 |
| 3,497,375 | 2/1970 | Rundle et al. | 117/5.1 |
| 3,811,933 | 5/1974 | Uffner et al. | 117/155 |
| 4,107,055 | 8/1978 | Sukornick et al. | 252/8.6 |
| 4,147,851 | 4/1979 | Raynolds | 526/245 |
| 4,539,006 | 9/1985 | Langford | 8/94.1 |
| 4,582,731 | 4/1986 | Smith | 427/421 |
| 4,734,227 | 3/1988 | Smith | 264/13 |
| 4,923,720 | 5/1990 | Lee et al. | 427/422 |
| 4,992,308 | 2/1991 | Sunol | 427/297 |
| 5,057,577 | 10/1991 | Matsuo et al. | 525/276 |
| 5,108,799 | 4/1992 | Hoy et al. | 427/422 |
| 5,149,753 | 9/1992 | Inukai et al. | 526/245 |
| 5,169,687 | 12/1992 | Sunol | 427/297 |
| 5,197,800 | 3/1993 | Saidman et al. | 366/136 |
| 5,199,956 | 4/1993 | Schlenker et al. | 8/473 |
| 5,211,342 | 5/1993 | Hoy et al. | 239/707 |
| 5,212,229 | 5/1993 | Taylor et al. | 521/556 |
| 5,250,078 | 10/1993 | Saus et al. | 8/475 |
| 5,269,815 | 12/1993 | Schlenker et al. | 8/475 |
| 5,290,602 | 3/1994 | Argyropoulos et al. | 427/421 |
| 5,298,032 | 3/1994 | Schlenker et al. | 8/475 |
| 5,308,648 | 5/1994 | Prince et al. | 427/212 |
| 5,326,823 | 7/1994 | Rolando et al. | 525/276 |
| 5,330,783 | 7/1994 | Saidman et al. | 427/8 |
| 5,340,614 | 8/1994 | Perman et al. | 427/2.24 |
| 5,350,795 | 9/1994 | Smith et al. | 524/507 |
| 5,362,519 | 11/1994 | Argyropoulos et al. | 427/385.5 |
| 5,407,132 | 4/1995 | Messerly et al. | 239/124 |
| 5,407,267 | 4/1995 | Davis et al. | 366/152 |
| 5,415,897 | 5/1995 | Chang et al. | 427/421 |
| 5,496,901 | 3/1996 | DeSimone | 526/89 |
| 5,508,060 | 4/1996 | Perman et al. | 427/2.14 |
| 5,512,058 | 4/1996 | Gavend et al. | 8/94.18 |
| 5,530,049 | 6/1996 | Dee et al. | 524/424 |
| 5,602,225 | 2/1997 | Montagna et al. | 528/25 |
| 5,676,705 | 10/1997 | Jureller et al. | 8/142 |
| 5,683,473 | 11/1997 | Jureller et al. | 8/142 |
| 5,683,977 | 11/1997 | Jureller et al. | 510/286 |

FOREIGN PATENT DOCUMENTS

| | | |
|---|---|---|
| 3904514 | 8/1990 | (DE) . |
| 3906724 | 9/1990 | (DE) . |
| 3906737 | 9/1990 | (DE) . |
| 4332219 | 3/1994 | (DE) . |
| 42 39 214 A1 | 5/1994 | (DE) . |
| 4429470 | 3/1995 | (DE) . |
| 4333221 | 4/1995 | (DE) . |
| 4336941 | 5/1995 | (DE) . |
| 4344021 | 6/1995 | (DE) . |
| 4404839 | 8/1995 | (DE) . |
| 492535 | 7/1992 | (EP) . |
| 0506 067 A1 | 9/1992 | (EP) . |
| WO 93/14259 | 7/1993 | (WO) . |
| WO 93/14255 | 7/1993 | (WO) . |
| WO 97/16264 | 5/1997 | (WO) . |
| WO 98/11293 | 3/1998 | (WO) . |

OTHER PUBLICATIONS

Rao et al., Textile Finishes and Fluorosurfactants, *Organofluorine Chemistry: Principles and Commercial Applications,* Banks et al. (eds), Plenum Press, New York pp. 321–338 (1994).

Bowman et al., Sizing and Desizing Polyester/Cotton Blend Yarns Using Liquid Carbon Dioxide, *Textile Res. J.* 66 (12):795–802 (1996).

DeSimone et al., Synthesis of Fluoropolymers in Supercritical Carbon Dioxide, *Science,* 257:945–947 (1992).

AATCC's 1997 Int'l Conference & Exhibition; XP–000722163, Speaker—Joseph M. DeSimone, Surfactants for Liquid and Supercritical Carbon Dioxide, *Textile Chemist and Colorist,* 29(8):28,30 (Aug. 1997).

International Search Report for PCT/US98/10897, dated Apr. 19, 1998.

*Primary Examiner*—Erma Cameron
(74) *Attorney, Agent, or Firm*—Myers Bigel Sibley & Sajovec

(57) ABSTRACT

A method of treating a substrate comprises contacting a surface of said substrate, with a pressurized fluid comprising carbon dioxide and a surface treatment component, the surface treatment component being entrained in the pressurized fluid and contacting the surface so that the surface treatment component lowers the surface tension of the surface of the substrate and treats the substrate. The contacting step is preferably carried out by immersion, the fluid is preferably a liquid or supercritical fluid, the substrate is preferably a metal or fabric substrate, and the surface treatment component is preferably a fluoroacrylate polymer.

12 Claims, No Drawings

METHOD OF COATING A SUBSTRATE IN CARBON DIOXIDE WITH A CARBON-DIOXIDE INSOLUBLE MATERIAL

RELATED APPLICATIONS

This application is a continuation of commonly owned, copending application Ser. No. 09/527,193, filed Mar. 17, 2000, which is a continuation of commonly owned, application Ser. No. 09/479,566, filed Jan. 7, 2000, which is a continuation of commonly owned, application Ser. No. 09/090,330, filed May 29, 1998, now issued as U.S. Pat. No. 6,030,663, which is a continuation-in-part of commonly owned application Ser. No. 08/866,348, filed May 30, 1997, now abandoned, the disclosures of all of which are incorporated by reference herein in their entirety.

FIELD OF THE INVENTION

The invention relates to treating surfaces of substrates. More particularly, the invention relates to treating the surfaces using a carbon dioxide fluid. The method is particularly useful for imparting stain resistance to fabrics.

BACKGROUND OF THE INVENTION

In a number of industrial applications, it is often desirable to treat the surface of an article or substrate in order to protect the substrate from contaminants. This typically includes controlling and enhancing the barrier properties of a surface to, for example, oils, grease, lipophilic materials, water, hydrophilic solutions, and dirt. Examples of such applications include SCOTCH GUARD® and STAIN MASTER® surface coating materials for textile articles such as furniture, clothing, and carpets to impart resistance to staining, and also treating articles formed from metal such as precision parts. It is often desirable to apply a surface treatment to an article in order to protect an article from foreign matter while also preserving the desirable physical properties of the article. With respect to textile-related articles for example, it is particularly desirable to maintain aesthetic properties relating to hand, drape, and texture.

For the most part, organic solvents such as hydrocarbons, chlorinated solvents, and chlorofluorocarbons (CFCs) have been employed in treating various substrates. Recently, however, the use of these solvents has been increasingly disfavored due to heightened environmental concerns. As one alternative, aqueous-based systems have been proposed for treating various articles. The use of the aqueous-based systems, however, also suffers from possible drawbacks, For example, contacting an article with water often adversely affects the physical properties of the article. For example, the texture and drape of a textile can be negatively impacted, or flash rusting of metal parts may occur due to water contact. Additionally, many low surface energy materials are largely insoluble in water, and must be formulated into emulsions or suspensions (an inherent disadvantage of aqueous systems). Moreover, water of suitable quality for use in coating and impregnation is becoming less available and more expensive.

$CO_2$-based dry cleaning systems that contain surfactant molecules (particularly molecules having a $CO_2$-philic group are described in, for example, U.S. Pat. Nos. 5,683,473; 5,676,705; and 5,683,977, all to Jureller. The purpose of the surfactant molecule proposed in the Jureller patents is to carry away soil from the fabrics, rather than to become deposited upon, and seal soil to, the fabric. Surface treatment is, accordingly, neither suggested nor disclosed.

In view of the above, it is an object of the present invention to provide a method of treating and/or impregnating a substrate which does not require the use of organic solvents or water.

It is also an object of the present invention to provide a method of impregnating a substrate which minimizes adverse affects to the physical properties of the substrate.

SUMMARY OF THE INVENTION

In one aspect, the invention provides a method of treating a substrate. The method comprises contacting, preferably by immersing, a surface of the substrate with a pressurized fluid comprising carbon dioxide and a surface treatment component. The surface treatment component is entrained in the pressurized fluid and contacts the surface so that the surface treatment component lowers the surface tension of the surface of the substrate and treats the substrate. Surface treatment components comprising fluoroacrylate polymers (including copolymers thereof) are preferred. The fluid is preferably a liquid or supercritical fluid.

In another aspect, the invention provides a method of imparting stain resistance to a fabric. The method comprises immersing the fabric in a pressurized fluid containing carbon dioxide and a surface treatment component. The surface treatment component is entrained in the pressurized fluid and contacts the fabric to lower the surface tension of the fabric. The surface treatment component is deposited on the fabric, and the carbon dioxide separated from the fabric so that the surface treatment component remains deposited on the fabric, thus rendering the fabric stain resistant.

DETAILED DESCRIPTION OF THE INVENTION

The invention will now be further described by the preferred embodiments presented herein. It should be understood however that the embodiments are to be interpreted as being illustrative of the invention and not as limiting the invention.

The invention relates to a method of treating a substrate in a pressurized system. The method includes the step of contacting a surface of the substrate with a fluid comprising carbon dioxide and a surface treatment component. The surface treatment component is entrained in the fluid and contacts the surface so that the surface treatment component lowers the surface tension of the substrate, In this instance, the "entrainment of the surface treatment component in the fluid" refers to a surface treatment component which may be solubilized, dissolved, emulsified, or dispersed in the bulk fluid during transport of the fluid to the substrate surface and also upon the interaction of the fluid with the substrate surface. Entrainment may also include surface treatment components which are insoluble in the carbon dioxide containing fluid but which may be physically dispersed in the fluid with or without the aid or a dispersing agent or the like. For the purposes of the invention, the term "lowers the surface tension" can be understood as reducing the surface tension of the substrate to the extent such that in end use commercial applications contaminant materials (aqueous, organics, solids, liquids, etc.) exhibit a reduced tendency to adhere or absorb onto the substrate surface. For illustrative purposes, the invention is to be differentiated from processes in which surface treatments are applied in a transient manner for treating materials. Such an instance involves sizing of textile yarns as set forth in Bowman et al., *Textile Res. J.* 66 (12), 795–802 (1996), in which coating materials are applied to the yarns and then removed. In contrast to the claimed invention, properties imparted by the sizing would render the substrate unusable.

Moreover, the surface treatment component is entrained in the fluid upon contacting the substrate. Such a process is distinguishable from spraying applications in which a fluid containing a coating material is emitted from an apparatus and thereafter undergoes a phase change, and is propelled by the fluid to the substrate. The surface treatment component of the present invention is entrained in the pressurized fluid upon contacting the substrate.

As described above, the surface tension is lowered as a result of applying the surface treatment component. Preferably, the surface tension is lowered by a value of 10 percent, and more preferably the surface tension is lowered by a value of 25 percent. The level of reduction can be on the order of 1 dyne/sq cm.

The fluid employed in the method of the invention is pressurized fluid, which is defined to be greater than ambient, typically at least 20 bar. For the purposes of the invention, the fluid contains carbon dioxide in a liquid, gaseous, or supercritical phase. If liquid $CO_2$ is used, the temperature employed during the process is preferably below 31° C. If gaseous $CO_2$ is used, it is preferred that the phase be employed at high pressure. As used herein, the term "high pressure" generally refers to $CO_2$ having a pressure from about 20 to about 500 bar. With respect to $CO_2$, the pressure of the gas is typically greater than 20 bar and less than its critical pressure.

In the preferred embodiment, the $CO_2$ is utilized in a dense (i.e., "supercritical" or "liquid" or "compressed gas") phase. Such a phase typically employs $CO_2$ at a density greater than the critical density, typically greater than 0.5 g/cc. As used herein, "supercritical" means that a fluid medium is at a temperature that is sufficiently high that it cannot be liquified by pressure. The thermodynamic properties of $CO_2$ are reported in Hyatt, *J. Org. Chem.* 49: 5097–5101 (1984); therein, it is stated that the critical temperature of $CO_2$ is about 31° C. For the purposes of the invention, the temperature and pressure conditions of the fluid are deemed by the thermophysical properties of pure carbon dioxide.

The carbon dioxide containing fluid used in the process of the invention may be employed in a single (e.g., non-aqueous) or multi-phase system with appropriate and known liquid components. Such components generally include, but are not limited to, a co-solvent or modifier, a surfactant, a co-surfactant, and other additives such as bleaches, optical brighteners, enzymes, rheology modifiers, sequestering agents, chelants, biocides, antiviral agents, fungicides, acids, polishes, radical sources, plasma, deep UV (photoresist) materials, crosslinking agents (e.g., difunctional monomers), metal soaps, sizing agents, antistatics, antioxidants, UV stabilizers, whiteners, fabric softener builders, detergents, dispersants, hydrotropes, and mixtures thereof. Any or all of the components may be employed in the process of the present invention prior to, during, or after the substrate is contacted by the $CO_2$ fluid.

For the purposes of the invention, multi-phase systems refers to processes in which the substrate may be treated in the fluid that contains a solid or fluid phase other than a carbon dioxide fluid phase. Other components in such systems include, for example, the surface treatment component itself, water under carbon dioxide head pressure which may be instrumental in lowering the $T_g$ in of a substrate and, in certain instances; may be needed for chemical reasons; immiscible liquids; and head pressurizing gases, the selection of which is known in the art. Non-aqueous fluids are currently preferred, particularly for metal and fabric substrates.

Examples of suitable co-solvents or modifiers include, but are not limited to, liquid solutes such as alcohols (e.g., methanol, ethanol, and isopropanol); fluorinated and other halogenated solvents (e.g., chlorotrifluoromethane, trichlorofluoromethane, perfluoropropane, chlorodifluoromethane, and sulfur hexafluoride); amines (e.g., N-methyl pyrrolidone); amides (e.g. dimethyl acetamide); aromatic solvents (e.g., benzene, toluene, and xylenes); esters (e.g., ethyl acetate, dibasic esters, and lactate esters); ethers (e.g., diethyl ether, tetrahydrofuran, and glycol ethers); aliphatic hydrocarbons (e.g., methane, ethane, propane, ammonium butane, n-pentane; and hexanes); oxides (e.g., nitrous oxide); olefins (e.g., ethylene and propylene); natural hydrocarbons (e.g., isoprenes, terpenes, and d-limonene); ketones (e.g., acetone and methyl ethyl ketone); organosilicones; alkyl pyrrolidones (e.g., N-methyl pyrrolidone); paraffins (e.g., isoparaffin); petroleum-based solvents and solvent mixtures; and any other compatible solvent or mixture that is available and suitable. Mixtures of the above co-solvents may be used. The above components can be used prior to, during, or after the substrate is contacted by the $CO_2$ fluid.

A surfactant or co-surfactant may be used in the fluid in addition to the surface treatment component. Suitable surfactants or co-surfactants are those materials which typically modify the action of the surface treatment component, for example, to enhance contact of the surface treatment component with the substrate. Exemplary co-surfactants that may be used include, but are not limited to, longer chain alcohols (i.e., greater than $C_8$) such as octanol, decanol, dodecanol, cetyl, laurel, and the like; and species containing two or more alcohol groups or other hydrogen bonding functionalities; amides; amines; and other like components. Potentially surface active components which also may be employed as co-surfactants include, but are not limited to, fluorinated small molecules, fluorinated acrylate monomers (e.g., hydrogenated versions), fluorinated alcohols and acids, and the like. Suitable other types of materials that are useful as co-surfactants are well known by those skilled in the art, and may be employed in the process of the present invention. Mixtures of the above may be used.

Various surface treatment components may be used in the process of the present invention. A surface treatment component is a material which is entrained in the fluid so as to treat the surface of the substrate and lower the surface tension of the substrate as set forth herein.

The term "treat" refers to the coating or impregnating of the substrate or substrate surface with the surface treatment component, with the surface treatment component tenaciously or permanently adhering to the surface after removal from the fluid, so that it serves as a protective coating thereon for the useful life of the coated substrate (e.g., is able to withstand multiple wash cycles when the substrate is a fabric or garment; is able to withstand a corrosive environment when the substrate is a part such as a metal part), until the substrate is discarded or must be re-treated. If desired, the surface active component may polymerize on the surface, or may be grafted onto the surface. Suitable surface treatment components include, but are not limited to, various monomer and polymer materials. Exemplary monomers include those which may be reactive or non-reactive, and contain fluorinated groups, siloxane groups or mixtures thereof.

Polymers which are employed as surface treatment components may encompass those which contain a segment which has an affinity for carbon dioxide ("$CO_2$-philic") along with a segment which does not have an affinity for carbon dioxide ("$CO_2$-phobic") which may be covalently joined to the $CO_2$-philic segment. Reactive and non-reactive polymers may be used. Exemplary $CO_2$-philic segments may include a fluorine-containing segment, a siloxane-containing segment, or mixtures thereof.

The fluorine-containing segment is typically a "fluoropolymer". The term "fluoropolymer," as used herein, has its conventional meaning in the art. See *generally Fluoropolymers* (L. Wall, Ed. 1972)(Wiley-Interscience Division of John Wiley & Sons); see also *Fluorine-Containing Polymers,* 7 Encyclopedia of Polymer Science and Engineering 256 (H. Mark et al. Eds., 2d Ed. 1985). The term "fluoromonomer" refers to fluorinated precursor monomers which make up the fluoropolymers. Any suitable fluoromonomer may be used in forming the fluoropolymers, including, but not limited to, fluoroacrylate monomers, fluoroolefin monomers, fluorostyrene monomers, fluoroalkylene oxide monomers (e.g., perfluoropropylene oxide, perfluorocyclohexene oxide), fluorinated vinyl alkyl ether monomers, and the copolymers thereof with suitable comonomers, wherein the comonomers are fluorinated or unfluorinated.

Fluorostyrenes and fluorinated vinyl alkyl ether monomers which may be polymerized by the method of the present invention include, but are not limited to, α-fluorostyrene; β-fluorostyrene; α,β-difluorostyrene; β,β-difluorostyrene; α, β,β-trifluorostyrene; α-trifluoromethylstyrene; 2,4,6-Tris(trifluoromethyl) styrene; 2,3,4,5,6-pentafluorostyrene; 2,3,4,5,6-pentafluoro-α-methylstyrene; and 2,3,4,5,6-pentafluoro-β-methylstyrene.

Tetrafluoroethylene copolymers can be used and include, but are not limited to, tetrafluoroethylene-hexafluoropropylene copolymers, tetrafluoroethylene-perfluorovinyl ether copolymers (e.g., copolymers of tetrafluoroethylene with perfluoropropyl vinyl ether), tetrafluoroethylene-ethylene copolymers, and perfluorinated ionomers (e.g., perfluorosulfonate ionomers; perfluorocarboxylate ionomers). High-melting $CO_2$-insoluble fluropolymers may also be used.

Fluorocarbon elastomers (see, e.g., 7 Encyclopedia of Polymer Science & Engineering 257) are a group of amorphous fluoroolefin polymers which can be employed and include, but are not limited to, poly(vinylidene fluoride-co-hexafluoropropylene); poly(vinylidene fluoride-co-hexafluoropropylene-co-tetrafluoroethylene); poly [vinylidene fluoride-co-tetrafluoroethylene-co-perfluoro (methyl vinyl ether)]; poly[tetrafluoroethylene-co-perfluoro (methyl vinyl ether)]; poly(tetrafluoroethylene-co-propylene; and poly(vinylidene fluoride-co-chlorotrifluoroethylene).

The term "fluoroacrylate monomer," as used herein, refers to esters of acrylic acid ($H_2C{=}CHCOOH$) or methacrylic acid ($H_2C{=}CCH_3COOH$), where the esterifying group is a fluorinated group such as perfluoroalkyl. A specific group of fluoroacrylate monomers which are useful may be represented by formula (I):

$$H_2C{=}CR^1COO(CH_2)_nR^2 \quad (I)$$

wherein:

n is preferably from 1 to 3;

$R^1$ is hydrogen or methyl; and $R^2$ is a perfluorinated aliphatic or perfluorinated aromatic group, such as a perfluorinated linear or branched, saturated or unsaturated $C_1$ to $C_{10}$ alkyl, phenyl, or naphthyl.

In a particular embodiment of the invention, $R^2$ is a $C_1$ to $C_8$ perfluoroalkyl or $—CH_2NR^3SO_2R^4$, wherein $R^3$ is $C_1$–$C_2$ alkyl and $R^4$ is $C_1$ to $C_8$ perfluoroalkyl.

The term "perfluorinated," as used herein, means that all or essentially all hydrogen atoms on an organic group are replaced with fluorine.

Monomers illustrative of Formula (I) above, and their abbreviations as used herein, include the following:

2-(N-ethylperfluorooctanesulfonamido) ethyl acrylate ("EtFOSEA");

2-(N-ethylperflooctanesulfonamido) ethyl methacrylate ("EtFOSEMA");

2-(N-methylperfluorooctanesulfonamido) ethyl acrylate ("MeFOSEA");

2-(N-methylperflooctanesulfonamido) ethyl methacrylate ("MeFOSEMA");

1,1-Dihydroperfluorooctyl acrylate ("FOA");

1,1-Dihydroperfluorooctyl methacrylate ("FOMA");

1,1,2,2-tetrahydro perfluoroalkyl acrylates;

1,1,2,2-tetrahydro perfluoroalkyl methacrylates;

1,1,2,2,3,3-hexahydro perfluoroalkyl acrylates; and 1,1,2,2,3,3-hexahydro perfluoroalkyl methacrylates.

Fluoroplastics may also be used and include those materials which are and are not melt processable such as crystalline or high melting or amorphous fluoroplastics.

Exemplary siloxane-containing segments include alkyl, fluoroalkyl, chloroalkyl siloxanes such as, but not limited to, polydimethyl siloxanes, polydiphenyl siloxanes, and polytrifluoro propyl siloxanes, Copolymers of the above may be employed which includes various types of monomers. Mixtures of any of the above may be used.

Exemplary $CO_2$-phobic segments may comprise common lipophilic, oleophilic, and aromatic polymers, as well as oligomers formed from monomers such as ethylene, α-olefins, styrenics, acrylates, methacrylates, ethylene and propylene oxides, isobutylene, vinyl alcohols, acrylic acid, methacrylic acid, and vinyl pyrrolidone. The $CO_2$-phobic segment may also comprise molecular units containing various functional groups such as amides; esters; sulfones; sulfonamides; imides; thiols; alcohols; dienes; diols; acids such as carboxylic, sulfonic, and phosphoric; salts of various acids; ethers; ketones; cyanos; amines; quaternary ammonium salts; and thiozoles.

Surface treatment components which are suitable for the invention may be in the form of, for example, random, block (e.g., di-block, tri-block, or multi-block), blocky (those from step growth polymerization), and star homopolymers, tapered polymers, tapered block copolymers, gradient block copolymers, other copolymers, and co-oligomers. Exemplary surface treatment components include, but are not limited to, poly(1,1-Dihydroperfluorooctyl methacryltate) ("poly FOMA"); (1,1-Dihydroperfluorooctyl methacrylate)-co-methyl methacrylate ("FOMA-co-MMA"); (1,1-Dihydroperfluorooctyl methacrylate)-block-methyl methacrylate ("FOMA-block-MMA"); poly-1,1,2,2-tetrahydro perfluoroalkyl acrylate (PTA-N or TA-N); poly[1,1,2,2-tetrahydro perfluoroalkyl acrylate-co-poly(ethylene glycol) methacrylate] (TA-N/PEG); polydimethylsiloxane-polyethylene glycol (PDMS-PEG); poly(1,1,2,2-tetrahydro perfluoroalkyl acrylates); poly(1,1,2,2-tetrahydro perfluoroalkyl methacrylates); poly(1,1-dihydro perfluoroalkyl acrylates); poly(1,1-dihydro perfluoroalkyl methacrylates); poly(1,1,2,2,3,3-hexahydro perfluoroalkyl acrylates); and poly (1,1,2,2,3,3-hexahydro perfluoroalkyl methacrylates), For the purposes of the invention, two or more surface treatment components may be employed in the fluid containing carbon dioxide.

Other surface treatment components may be used which do not have distinct $CO_2$ philic and $CO_2$ phobic segments, e.g., perfluoropolymers. Exemplary surface treatment components which may be used include, but are not limited to, those described in Rao et al., *Textile Finishes and Fluorosurfactants, Organofluorine Chemistry: Principals and Comnmercial Applications,* Banks et al. (eds.) Plenum Press, New York (1994).

The surface treatment component may be applied in various amounts, In the instance where the component is applied as a low level surface treatment, it is preferred to employ the surface treatment component such that the weight of the substrate is less than about 5 percent of surface treatment component, and more preferably less than about 1 weight percent. In the instance where the surface treatment component is applied as a high level surface treatment, it is preferred that the surface treatment component is employed in amounts such that the weight of the substrate is greater than about 2 weight percent of surface treatment component.

Other additives may be employed with the carbon dioxide, preferably enhancing the physical or chemical properties of the fluid or acting on the substrate. Such additives may include, but are not limited to, bleaching agents, optical brighteners, bleach activators, corrosion inhibitors, enzymes, builders, co-builders, chelants, sequestering agents, and rheology modifiers. Mixtures of any of the above may be used. As an example, rheology modifiers are those components which may increase the viscosity of the fluid. Exemplary polymers include, for example, perfluoropolyethers, fluoroalkyl polyacrylics, and siloxane oils, including those which may be employed as rheology modifiers. Additionally, other molecules may be employed including $C_1$–$C_{10}$ alcohols, $C_1$–$C_{10}$ branched or straight-chained saturated or unsaturated hydrocarbons, ketones, carboxylic acids, N-methyl pyrrolidone, dimethylacetyamide, ethers, fluorocarbon solvents, and chlorofluorocarbon solvents. For the purposes of the invention, the additives are typically utilized up to their solubility limit during the contacting of the substrate.

Various substrates may be treated in the process of the invention. Such substrates include, but are not limited to, fabrics/textiles, porous and non-porous solid substrates such as metals (e.g., metal parts), glass, ceramics, synthetic and natural organic polymers, synthetic and natural inorganic polymers, other natural materials, and composite mixtures thereof. In particular, textile substrates are treated by the process, and encompass a larger number of materials. Such substrates are preferably knit, woven, or non-woven fabrics such as garments, upholstery, carpets, tents, clean room suits, parachutes, footwear, etc. formed from natural or synthetic fibers such as wool, cotton, silk, etc. Articles (e.g., ties, dresses, blouses, shirts, and the like) formed of silk or acetate are particularly well suited for treatment by the process of the invention.

The application of the surface treatment additive is advantageous with respect to medical devices, implants, and other articles of manufacture. The surface treatment component may be used in corrosive environments such as marine fishing equipment, for example.

In accordance with the invention, by virtue of the application of the surface treatment component, the surface tension is lowered such that contaminants exhibit reduced adherence or absorbency onto the substrate surface during, for example, commercial use. These contaminants are numerous and include, for example, water, inorganic compounds, organic compounds, polymers, particulate matter, and mixtures thereof.

In another aspect, the invention relates to a method of imparting stain resistance or stain release properties to a fabric. The method includes immersing the fabric in a fluid containing carbon dioxide and a surface treatment component. As defined herein, the surface treatment component is entrained in the fluid upon contacting the fabric to lower the surface tension of the fabric. The pressure of the fluid may then be decreased such that the surface treatment component treats the fabric and imparts stain resistance to the fabric. The term "decreasing the pressure of the fluid" refers to lowering the fluid to low pressure (e.g., ambient) conditions such that the surface treatment component is no longer dissolved in the fluid. It should be understood that it is not necessary to drive the surface treatment component onto the surface. For example, the chemistry of the surface treatment component may be possibly engineered such that it "bites" (e.g., bonds/binds) to the surface.

In an alternative embodiment, the surface treatment component may be deposited onto the surface of a substrate prior to the surface contacting the fluid containing carbon dioxide. Thereafter, the substrate is exposed to the fluid. This embodiment may be employed when using carbon dioxide insoluble but highly swellable surface treatment components.

The process of the invention may be used in conjunction with other steps, the selection of which are known in the art. For example, the process may be used simultaneously with or subsequent to a cleaning process which may remove contaminants from a substrate. Cleaning processes of this type include any technique relating to the application of a fluid or solvent to a substrate, with the fluid or solvent typically containing a surfactant and other cleaning or processing aids if desired. After the contaminant is removed from the surface, the surface treatment component may be applied to the substrate surface in accordance with the invention. Prior to using a cleaning process, it should be understood that a pre-treatment formulation may be applied to the substrate. Suitable pre-treatment formulations are those which may include solvents, chemical agents, additives, or mixtures thereof. The selection of a pre-treatment formulation often depends on the type of contaminant to be removed or substrate involved.

Operations subsequent to the treating of the substrate with the surface treatment component may also be performed, the operations of which are known by the skilled artisan. For example, the method may also include the step of washing the fabric with a suitable solvent subsequent to the treatment of the fabric with the surface treatment component. Other post-treatment (i.e., conditioning) steps may be carried out. For example, the substrate may be heated to set the surface treatment component. In an alternative embodiment, the substrate may be exposed to a reduced pressure. Also, the substrate may be exposed to a chemical modification such as being exposed to acid, base, UV light, and the like.

The process of the invention may be carried out using apparatus and techniques known to those skilled in the art. The process typically begins by providing a substrate in an appropriate pressurized system (e.g., vessel) such as, for example, a batchwise or semi-continuous system. The surface treatment component is also usually added to the vessel at this time. A fluid containing carbon dioxide is then typically added to the vessel and the vessel is heated and pressurized. The surface treatment component and the fluid may be added to the vessel simultaneously, if so desired. Additives (e.g., co-solvents, co-surfactants, and the like) may be added at an appropriate time.

After charging the vessel with the fluid containing carbon dioxide, the fluid contacts the substrate and the surface treatment component treats the substrate. During this time, the vessel is preferably agitated by known techniques including, for example, mechanical agitation; sonic, gas, or liquid jet agitation; pressure pulsing; or any other suitable mixing technique.

Care must be taken to insure that the treatment component is in fact deposited on the substrate, rather than carried away from the substrate as in a cleaning system. In general, four different techniques for depositing the treatment component, or coating material, onto the substrate, can be employed. In each, the coating is preferably initially provided in the fluid as a stable solution, suspension or dispersion, for subsequent deposition on the substrate. Most preferably the formulation of fluid and surface treatment component is homogeneous (e.g., optically clear) at initiation of the contacting step, particularly for fabric substrates, but this is not as essential for metal substrates were impregnation of the substrate is not an issue:

(A) The coating is dissolved or solubilized in the fluid at a given temperature and pressure, followed by contacting the fluid to the substrate and reduction of fluid pressure. This effects a lowering of the fluid density below a critical level, thus depositing the coating onto the substrate. The system pressure may be lowered by any suitable means, depending upon the particular equipment employed.

(B) The coating is deposited onto a substrate by contacting a fluid containing the coating to the substrate, and then diluting the fluid to a point that destabilizes the coating in the fluid resulting in deposition of the coating onto the substrate.

(C) The coating-containing fluid is contacted to the substrate at sub-ambient temperature and a given pressure, followed by increasing the temperature of the fluid to a point at which the coating destabilizes in the fluid and the coating is deposited onto the substrate.

(D) The coating is provided in the fluid at a sub-ambient temperature in a high pressure vessel, then metered into a second high pressure vessel containing a substrate and the fluid at a temperature sufficiently hither to destabilize the metered fluid and cause the deposition of the coating onto the substrate.

In all of the foregoing, the depositing step is followed by separating the carbon dioxide fluid from the substrate by any suitable means, such as by pumping or venting the fluid from the vessel containing the substrate after the deposition step. As will be appreciated, it is not necessary that all, or even a major portion of, the surface treatment component be deposited from the fluid onto the substrate, so long as a sufficient quantity is deposited to achieve the desired coating effect on the substrate after it is separated from the fluid.

The following examples are provided to illustrate the present invention, and should not be construed as limiting thereof.

EXAMPLE 1

Coating of Poly-cotton fabric (50/50) with 50 k PFOMA

A water and stain repellant coating is applied to a sample of poly-cotton fabric by adding the fabric and 1 wt/vol % 50 k of PFOMA to a high pressure vessel: $CO_2$ is added at a pressure of 1900 psi and the vessel contents are agitated for 10 minutes. The $CO_2$ is vented and the cloth sample is removed and weighed. The weight-on-goods (W.O.G.) is calculated by the following equation: W.O.G. (%)=((final weight of fabric−initial weight of fabric)/initial weight of fabric)×100. The W.O.G. for 50 k PFOMA on poly-cotton is found to be 20.0%.

The absorbency is tested in accordance with AATC Test Method 79-1995. The wetting time for poly-cotton fabric coated with 50 k PFOMA is 60+ seconds.

EXAMPLE 2

Coating of Poly-cotton fabric (50/50) with 9.3 k FOMA-co-MMA (3:1)

A water and stain repellant coating of 9.3 k of FOMA-co-MMA (3:1) is applied to a sample of poly-cotton fabric at 2500 psi similar to Example 1. The W.O.G. is found to be 40.7%. The wetting time for the absorbency test is found to be 60+ seconds.

EXAMPLE 3

Coating, of Poly-cotton fabric (50/50) with 50 k FOMA-b-9.3 k MMA (5:1)

A water and stain repellant coating of 50 k of FOMA-b-9.3 k MMA (5:1) is applied to a sample of poly-cotton fabric at 2500 psi similar to Example 1. The W.O.G. is found to be 30.6%. The wetting time for the absorbency test is found to be 60+ seconds.

EXAMPLE 4

Coating of Poly-cotton fabric (50/50) with 9.3 k FOMA-b-MMA (5:1)

A water and stain repellant coating of 9.3 k of FOMA-b-MMA (5:1) is applied to a sample of poly-cotton fabric at 2500 psi similar to Example 1. The W.O.G. is found to be 30.5%. The wetting time for the absorbency test is fond to be 60+ seconds.

EXAMPLE 5

Coating of Poly-cotton fabric (50/50) with 50 k FOMA-co-MMA (4:1)

A water and stain repellant coating of 50 k of FOMA-co-MMA (4:1) is applied to a sample of poly-cotton fabric at 2500 psi similar to Example 1. The W.O.G. is found to be 45.4%. The wetting time for the absorbency test is found to be 60+ seconds.

EXAMPLE 6

Coating of Poly-cotton fabric (50/50) with 80 k PTO-N

A water and stain repellant coating of 80 k of PTA-N is applied to a sample of poly-cotton fabric at 2500 psi similar to Example 1. The W.O.G. is found to be 19.4%. The wetting time for the absorbency test is found to be 60+ seconds.

EXAMPLE 7

Coating of Poly-cotton fabric (50/50) with 30 k PFON (FOMA 7)

A water and stain repellant coating of 30 k of PFOMA is applied to a sample of poly-cotton fabric at 2300 psi similar to Example 1. The W.O.G. is found to be 27.8%. The wetting time for the absorbency test is found to be 60+ seconds.

EXAMPLE 8

Coating of Poly-cotton fabric (50/50) with TA-N/10% PEG

A water and stain repellant coating of TA-N/10% PEG is applied to a sample of poly-cotton fabric at 2300 psi similar to Example 1. The W.O.G. is found to be 15.3%. The wetting time for the absorbency test is found to be 60+ seconds.

EXAMPLE 9

Coating of Poly-cotton fabric (50/50) with 2000 PDMS-g-350 PEG (1.3 wt % PEG)

A water and stain repellant coating of 2000 PDMS-g-350 PEG (1.3 wt % PEG) is applied to a sample of poly-cotton fabric at 1500 psi similar to Example 1. The W.O.G. is found to be 4.9%. The wetting time for the absorbency test is found to be 60+ seconds.

EXAMPLE 10

Coating of Poly-cotton fabric (50/50) with 600 PDMS-g-350 PEG (75 wt % PEG)

A water and stain repellant coating of 600 PDMS-g-350 PEG (75 wt % PEG) is applied to a sample of poly-cotton fabric at 1200 psi similar to Example 1. The W.O.G. is found to be 36. percent. The wetting time for the absorbency test is found to be 60+ seconds.

EXAMPLE 11

Coating of Acetate fabric with 80 k PTA-N

A water and stain repellant coating is applied to a sample of acetate fabric by adding the fabric and 1.2 wt/vol % of 50 k PFOMA to a high pressure vessel. $CO_2$ is added at a pressure of 2000 psi and the vessel contents are agitated for 15 minutes. The $CO_2$ is vented and the cloth sample is removed and weighed. The W.O.G. for 80 k PTA-N on acetate is found to be 13.8%.

EXAMPLE 12

Coating of Silk fabric with 80 k PTA-N

A water and stain repellant coating is applied to a sample of silk fabric by adding the fabric and 1.2 wt/vol % of 50 k PFOMA to a high pressure vessel. $CO_2$ is added at a pressure of 2000 psi and the vessel contents are agitated for 15 minutes. The $CO_2$ is vented and the cloth sample is removed and weighed. The W.O.G. for 80 k PTA-N on silk is found to be 39.0%.

EXAMPLE 13

Coating of silk fabric with TA-N/25% PEG

A water and stain repellant coating is applied to a sample of silk fabric by adding the fabric and 0.1 wt/vol % TA-N/25% PEG to a high pressure vessel. $CO_2$ is added to 2500 psi and the vessel contents are agitated for 15 minutes. The vessel is rinsed for 5 minutes at 2500 psi and the $CO_2$ is vented. The cloth sample is removed and weighed. The weight-on-goods (W.O.G.) Is calculated by the following equation: W.O.G.(%)=((final weight of fabric−initial weight of fabric)/initial weight of fabric)×100. The W.O.G. for TA-N/25T PEG on silk is found to be 14.7%.

The absorbency is tested in accordance with AATC Test Method 79-1995. The wetting time for poly-cotton fabric coated with 50 k PFOMA is 60+ seconds.

EXAMPLE 14

Coating of acetate taffeta fabric with TA-N/25% PEG

A water and stain repellant coating of TA-N/25% PEG is applied to a sample of acetate taffeta fabric at 2500 psi as in Example 1. The W.O.G. is found to be −0.7%. The wetting time for the absorbency test is found to be 60+ seconds. In addition, there is found to be no difference in the fabric hand of before and after samples.

EXAMPLE 15

Coating of poly-cotton fabric with TA-N/25% PEG

A water and stain repellant coating of TA-N/25% PEG is applied to a sample of poly-cotton fabric at 2500 psi as in Example 1. The W.O.G. is found to be 2.4%. The wetting time for the absorbency test is found to be 60+ seconds. In addition, there is found to be no difference in the fabric hand of before and after samples.

EXAMPLE 16

Coating of linen suiting fabric with TA-N/25% PEG

A water and stain repellant coating of TA-N/25% PEG is applied to a sample of linen suiting fabric at 2500 psi as in Example 1. The W.O.G. is found to be 3.4%. The wetting time for the absorbency test is found to be 60+ seconds. In addition, there is found to be no difference in the fabric hand of before and after samples.

EXAMPLE 17

Coating of cotton fabric with TA-N/25% PEG

A water and stain repellant coating of TA-N/25% PEG is applied to a sample of cotton fabric at 2500 psi as in Example 1. The W.O.G. is found to be 1.1%. The wetting time for the absorbency test is found to be 60+ seconds. In addition, there is found to be no difference in the fabric hand of before and after samples.

EXAMPLE 18

Coating of texturized stretch nylon 6.6 fabric with TA-N/25% PEG

A water and stain repellant coating of TA-N/25% PEG is applied to a sample of Texturized stretch nylon 6.6 fabric at 2500 psi as in Example 1. The W.O.G. is fond to be 3.0%. The wetting time for the absorbency test is found to be 60+ seconds.

EXAMPLE 19

A copolymer comprised of units derived from the polymerization of 1,1,2,2-tetrahydro perfluoroalkyl acrylate with butyl acrylate and meta(2-isocyano-2-propyl) styrene, was dissolved in $CO_2$ in a high pressure vessel with a copolymer comprised of units derived from the polymerization of 1,1,2,2-tetrahydro perfluoroalkyl acrylate with butyl acrylate and poly(propylene glycol) acrylate to yield a solution of approximately 1.3 wt. % polymer.

The solution containing the polymers, both of which contained at least 50 wt. % perfluoroalkyl acrylate, was homogeneous at 150 bar and 25° C. A swatch of nylon fabric weighing 25 grams was evenly wrapped numerous times around a perforated metal beam placed in a separate high-pressure vessel that was then filled with liquid $CO_2$ at 25 C. and 150 bar. The fluorocarbon containing acrylate solution as then pumped to the high-pressure vessel containing the substrate such that the solution flowed in a radial fashion through the beam and fabric and back into the original high-pressure vessel for a time sufficient to ensure steady state conditions in both vessels.

The vessel containing the nylon was then isolated from the rest of the systems at which point the density of the solution was lowered by slowly removing $CO_2$ from the vessel so that the density of the solution dropped causing the dissolved fluorocarbon containing polymer to coat in and onto the nylon substrate. After removing the rest of the $CO_2$ from the vessel containing the nylon, the fabric was removed from the beam. The nylon fabric was then placed in an oven at a temperature a 125° C. for 20 minutes to cure and crosslink the coating on the fabric. The weight on goods (WOG) of the coating was determined to be 3.0% and subsequent testing was carried out to measure the efficacy of the coating as a water and oil repellant finish.

Water and oil repellency were assessed according to AATCC Test Method 22-1996 and AATCC test method 118-1992, Water Repellency: Spray Test and Oil Repellency: Hydrocarbon Resistance Test, respectively. Some of the nylon swatches were laundered to determine the wash durability of the repellent finish. Ratings for water repellency are based on the following scale.

100 (ISO 5)-No sticking or wetting of upper surface.

90 (ISO 4)-Slight random sticking of upper surface.

80 (ISO 3)-Wetting of upper surface at spray points.

70 (ISO 2)-Partial wetting of whole upper surface.

50 (ISO 1)-Complete wetting of whole upper surface.

0-Complete wetting of whole upper and lower surfaces.

Oil repellency is based on drops of standard test liquids consisting of a selected series of hydrocarbons with varying surface tensions. These test liquids are placed on the fabric surface and observed for wetting, wicking and contact angle. The finish earns a rating based on the highest numbered hydrocarbon liquid that does not wet the surface of the fabric after 30+/−2 seconds. The higher this number is, the more effective the finish is an oil repellent finish. The ratings correspond to the following hydrocarbon liquids.

| AATCC Oil Grade Number | Composition |
|---|---|
| 0 | None (fails Kaydol) |
| 1 | Kaydol |
| 2 | 65:35 Kaydol: n-hexadecane by volume |
| 3 | n-hexadecane |
| 4 | n-tetradecane |
| 5 | n-dodecane |
| 6 | n-decane |
| 7 | n-octane |
| 8 | n-heptane |

Swatches cut from the coated nylon fabric earned the following water and oil repellency scores based on the criteria defined above. The coated nylon swatches had "hand" qualities comparable to non-coated samples.

| | Water Repellency | Oil Repellency |
|---|---|---|
| Nylon #1 (not coated) | 0 | — |
| Nylon #2 (not coated) | — | 0 |
| Nylon #3 (coated) | 100 (ISO 5) | — |
| Nylon #4 (coated) | — | 8 |
| Nylon #5 (coated/10 launderings) | 80 (ISO 3) | — |
| Nylon #6 (coated/10 launderings) | — | 7 |

EXAMPLE 20

Two silk swatches, 7"×14", were coated in $CO_2$ as in example 1 with a coating consisting of 2 copolymers synthesized via free radical polymerization of a perfluoroalkyl acrylate, poly(propylene glycol) acrylate, poly(propylene glycol) methyl ether acrylate, and butyl acrylate, and polymerization of perfluoroalkyl acrylate, butyl acrylate, and meta(2-isocyano-2-propyl) styrene. Both of the copolymers consisted of approximately 50 mole % perfluoroalkyl acrylate. The coated silk swatches contained approximately 2.8% WOG coating and displayed fabric hand qualities indistinguishable from non-coated silk. Repellency grades were ascribed as follows.

| | Water Repellency | Oil Repellency |
|---|---|---|
| Silk #1 (not coated) | 0 | — |
| Silk #2 (not coated) | — | 0 |
| Silk #3 (coated) | 100 (ISO 5) | — |
| Silk #4 (coated) | — | 8 |
| Silk #5 (coated*) | — | 8 |

*20 minute perchloroethylene rinse and dry.

EXAMPLE 21

Two wool fabric swatches were coated as described in example 1 with a coating of similar composition to that used in example 2. The coated wool swatches had a fabric "hand" similar to non-coated wool and a WOG of approximately 4.5%. Repellency grades were ascribed as follows.

| | Water Repellency | Oil Repellency |
|---|---|---|
| Wool #1 (not coated) | — | 0 |
| Wool #2 (coated) | — | 7 |
| Wool #3 (coated*) | — | 8 |

*20 minute perchloroethylene rinse and dry.

EXAMPLE 22

Two cotton/polyester blended fabric swatches were coated as described in example 1 with a coating of similar composition to that described in example 1. Fabric swatches containing approximately 1.5% WOG coating were ascribed the following repellency ratings.

| | Water Repellency | Oil Repellency |
|---|---|---|
| Cotton/poly #1 (not coated) | 0 | — |
| Cotton/poly #2 (not coated) | — | 0 |
| Cotton/poly #3 (coated) | 70 (ISO 2) | — |
| Cotton/poly #4 (coated) | — | 7 |
| Cotton/poly #5 (coated*) | 50 (ISO 1) | — |

*10 simulated home launderings

EXAMPLE 23

Type B

A coating synthesized by free radical polymerization of perfluoroalkyl acrylate, butyl acrylate, poly(propylene glycol) methyl ether acrylate, and poly(propylene glycol) methacrylate containing approximately 25 mole % perfluoroalkyl acrylate was dissolved in a mixture of methyl ethyl ketone (MEK) and dipropylene glycol methyl ether acetate. In this case, 1.75 grams of the polymer was first dissolved in 10 mL of MEK and then diluted with dipropylene glycol methyl ether acetate to a total volume of 70 mL, 2.5 w/v% solution.

The coating solution was added to a high-pressure vessel, Vessel 'A'. In a separate high-pressure vessel, vessel 'B', containing a perforated stainless steel basket, nylon swatches were added. The basket in vessel 'B' could be rotated by means of a magnetically coupled drive system with an external DC motor. Vessel 'A' and 'B' were sealed at which point liquid $CO_2$ at saturated vapor pressure, ~60 bar at 25° C., was metered into vessel 'A' to a total volume of ~250 mL. The mixture remained clear and homogenous. Then, liquid $CO_2$ at saturated vapor pressure was added to vessel 'B' to a volume in which the vessel was approximately ½ full. The basket containing the swatches was rotated at approximately 35 rpm at which point the $CO_2$/cosolvent/polymer solution was slowly metered from vessel 'A' to vessel 'B' until all liquid had been transferred from one vessel to the other. In this process, the coating solution containing coating, cosolvent, and $CO_2$ became diluted with $CO_2$ such that the coating went through a cloud point. As the coating destabilized in vessel 'B' it coated out onto the surfaces of the swatches. The basket in vessel 'B' continued to rotate until the liquid $CO_2$ was clear indicating that all of the coating had depleted onto the surfaces of the fabric. After removing the $CO_2$ from both vessels the nylon fabric swatches were removed and placed in a laboratory oven for 15 minutes at 110° C. to activate the fluorocarbon coating, The swatches, which contained on average 3.5% WOG coating were then subjected to treatment with drops of water and olive oil indicating good repellency to both.

EXAMPLE 24

Silk ties are coated in a process similar to that described in example 23, yielding finished garments with good oil and water repellent properties.

EXAMPLE 25

Wool swatches are coated in a process consistent with that described in example 23, imparting water and oil repellent properties to the fabric.

EXAMPLE 26

A process consistent with that described in example 23 is used to coat a mixture a fabric swatches including cotton, polyester, nylon, silk, and wool imparting water and oil resistant properties to all fabric types.

EXAMPLE 27

A process as described in example 23 is performed subsequent to cleaning of garments using a $CO_2$-based garment cleaning process, to impart soil release properties thereto. The process is carried out in the same vessel as is the cleaning process.

EXAMPLE 28

A process as described in example 23 is performed concurrently with a $CO_2$-based garment cleaning process.

EXAMPLES 29–30

The premise behind these depletion methods relates to the solubility of amorphous fluoropolymers in $CO_2$ at varying $CO_2$ densities. For example, a polymer may be soluble in $CO_2$ at 5° C. and 40 bar, but not soluble at 25° C. and 60 bar. This is a result of the difference in density of the liquid $CO_2$ between the two scenarios, ~0.9 g/mL to ~0.7 g/mL respectively.

EXAMPLE 29

Type C

An oil and water repellent finish is added to fabric swatches in the following manner. Fabric swatches are added to a high-pressure vessel equipped with a magnetically coupled stirring drive, and a heat exchanger. Copolymer comprised of units derived from the polymerization of 1,1,2,2-tetrahydro perfluoroalkyl acrylate with butyl acrylate and poly(propylene glycol)methyl ether acrylate is added to the vessel and it is sealed. Liquid $CO_2$ is added to fill the vessel approximately half full at 0° C., ~36 bar. Stirring is initiated for a time sufficient to allow the coating to dissolve in the vessel, at which point the vessel is warmed to 25° C. under continued stirring. $CO_2$ is then removed from the vessel, as are the water and oil repellent fabric swatches.

EXAMPLE 30

Type D

An oil and water repellent finish is added to fabric swatches in the following manner. Fabric swatches are added to a high-pressure vessel, vessel 'A', equipped with a magnetically coupled stirring drive. Copolymer comprised of units derived from the polymerization of 1,1,2,2-tetrahydro perfluoroalkyl acrylate with butyl acrylate and poly(propylene glycol)methyl ether acrylate is added to a separate high-pressure vessel, vessel 'B', equipped with a magnetically coupled stirring drive and a heat exchanger. Liquid CO, is added to vessel 'A' to fill the vessel approximately ½ full, at a saturated vapor pressure of ~60 bar@25° C. Liquid $CO_2$ is then added to vessel 'B'. that has been cooled to 0° C. to fill it approximately ½ full, and stirring is initiated. After equilibration, the saturated vapor pressure in vessel 'B' is approximately 36 bar. After sufficient time to dissolve the polymer in vessel 'B', the $CO_2$ solution is slowly added to vessel 'A' using a high-pressure syringe pump and the corresponding high-pressure tubing. After time sufficient to deplete the coating onto the fabric, $CO_2$ is remove from both vessels followed by the oil and water repellent fabric swatches.

The foregoing is illustrative of the present invention and is not to be construed as limiting thereof. The invention is defined by the following claims, with equivalents of the claims to be included therein.

That which is claimed is:

1. A method of coating a substrate, said method comprising the steps of:

depositing a surface treatment component on a surface portion of a substrate, then immersing said surface portion of said substrate in a pressurized liquid or supercritical fluid comprising carbon dioxide wherein said surface treatment component is insoluble in carbon dioxide and swellable in carbon dioxide; and removing said substrate from said pressurized liquid or supercritical fluid with said treatment component adhered thereto;

wherein said surface treatment component comprises a $CO_2$-phobic segment, and wherein said $CO_2$-phobic segment is selected from the group consisting of lipophilic polymers, oleophilic polymers, aromatic polymers, oligomers, and mixtures thereof.

2. The method according to claim 1, wherein said carbon dioxide is present in a supercritical state.

3. The method according to claim 1, wherein said carbon dioxide is present in a liquid state.

4. The method according to claim 1, wherein said surface treatment component further comprises a fluoroacrylate polymer.

5. A method according to claim 1, wherein said substrate is a solid substrate.

6. A method according to claim 1, wherein said solid substrate comprises a material selected from the group consisting of metals, glass, ceramics, organic polymers, inorganic polymers, and mixtures thereof.

7. A method according to claim 6, wherein said solid substrate comprises metal.

8. A method according to claim 6, wherein said solid substrate comprises glass.

9. A method according to claim 6, wherein said solid substrate comprises ceramic.

10. A method according to claim 1, wherein substrate comprises a textile fabric.

11. The method according to claim 1, wherein said surface treatment component further comprises a $CO_2$-philic segment selected from the group consisting of fluorine-containing segments, siloxane-containing segments, and mixtures thereof.

12. The method according to claim 1, wherein said surface treatment component further comprises a siloxane-containing segment.

* * * * *